United States Patent [19]

Knapp

[11] 4,007,722

[45] Feb. 15, 1977

[54] FUEL INJECTION SYSTEM

[75] Inventor: Heinrich Knapp, Leonberg-Silberberg, Germany

[73] Assignee: Robert Bosch G.m.b.H., Stuttgart, Germany

[22] Filed: Sept. 10, 1975

[21] Appl. No.: 611,846

[30] Foreign Application Priority Data

Sept. 18, 1974 Germany ..... 2444598

[52] U.S. Cl. ..... 123/139 AW; 123/119 R; 261/50 A

[51] Int. Cl.[2] ..... F02M 69/00

[58] Field of Search ... 123/139 AW, 119 R, 32 EA; 261/50 A

[56] References Cited

UNITED STATES PATENTS

| | | | |
|---|---|---|---|
| 3,728,993 | 4/1973 | Eckert et al. | 123/119 R |
| 3,791,359 | 2/1974 | Eckert et al. | 123/119 R |
| 3,867,917 | 2/1975 | Zeyns et al. | 123/119 R |
| 3,974,811 | 8/1976 | Stumpp et al. | 123/139 AW |

*Primary Examiner*—C. J. Husar
*Assistant Examiner*—Tony M. Argenbright
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, a pressure control valve connected to the control pressure conduit and a relief valve also connected to the control pressure conduit and connected to the fuel metering and distributing valve. The relief valve includes a sleeve valve and a throttle which is controlled by the sleeve valve. The throttle opens into a pressure chamber disposed on one side of a slide member of the fuel metering and distributing valve. This slide member exerts the restoring force applied to the air sensing element.

5 Claims, 1 Drawing Figure

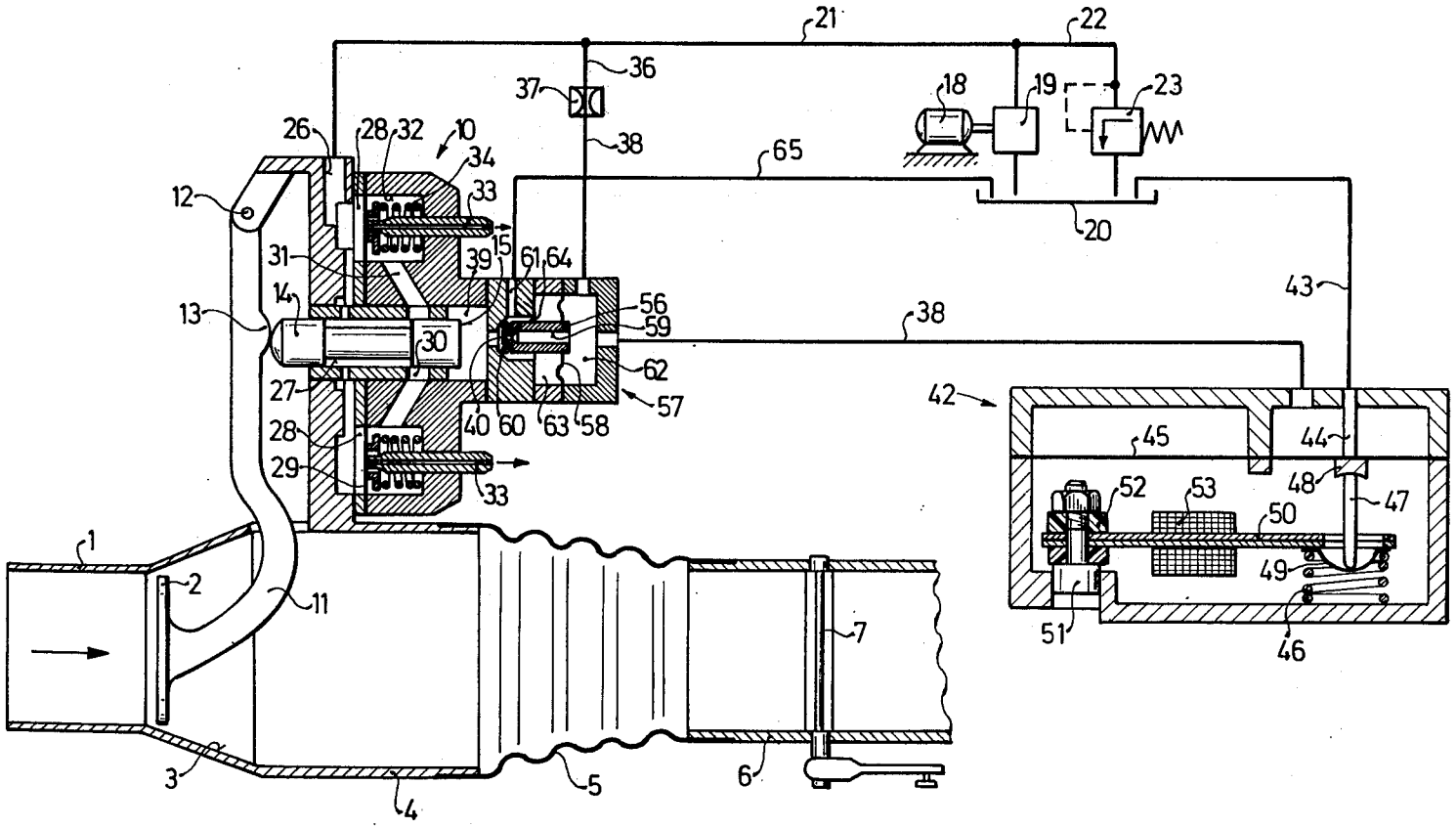
1
2
3
4
5
6
7
10
11
12
13
14
15
18
19
20
21
22
23
26
27
28
29
30
31
32
33
34
36
37
38
39
40
42
43
44
45
46
47
48
49
50
51
52
53
56
57
58
59
60
61
62
63
64
65

FUEL INJECTION SYSTEM

CROSS-REFERENCE TO RELATED APPLICATIONS

This application discloses subject matter in common with application Ser. No. 538,404 filed on Jan. 3, 1975, now U.S. Pat. No. 3,974,811, by Gerhard Stumpp et al, and with application Ser. No. 577,061 filed on May 13, 1975, now U.S. Pat. No. 3,983,856, by Gerhard Stumpp et al. All of these applications have a common assignee.

BACKGROUND OF THE INVENTION

The present invention relates to a fuel injection system for an externally ignited internal combustion engine.

The system operates on fuel which is continuously injected into the suction tube of the engine in which an air sensing element and an arbitrarily operable throttle valve are disposed in series. The air sensing element is displaced by and in proportion to the throughgoing quantity of air against a restoring force. In the course of its excursion the air sensing element displaces a movable component of a valve which is disposed in the fuel supply line and which is intended for metering a quantity of fuel in proportion to the quantity of air. The above-noted restoring force is supplied by liquid under pressure which is delivered continuously under constant, but arbitrarily variable pressure through a control pressure conduit and which exerts a force on a control plunger transferring the restoring force and projecting with its one front face into a pressure chamber. The pressure of the pressurized liquid is variable by at least one pressure control valve which is controllable as a function of the engine parameters and which contains a temperature-dependent control element.

Fuel injection systems of this type are designed to automatically provide a good fuel-air mixture for all operating conditions of the internal combustion engine so as to burn the fuel as completely as possible and thus prevent toxic gases from being produced, or at least considerably reduce the toxic gases while obtaining maximum performance of the internal combustion engine, with minimum fuel consumption. The quantity of fuel must therefore be very accurately metered in accordance with the requirements of each operating state of the internal combustion engine.

In the case of known fuel injection systems of this type, the quantity of fuel which is metered is, as far as possible, proportionate to the quantity of air flowing through the suction tube of the engine. The ratio of the quantity of fuel which is metered to the quantity of air may be varied by changing the restoring force on the air sensing element as a function of the operating parameters by means of a pressure control valve.

It has been found that during the warm-up phase of the internal combustion engine the fuel-air mixture can be substantially leaner during stationary operation of the engine than when the throttle valve is suddenly opened. Accordingly, both the fuel consumption and the emission of toxic substances can be lowered during the warm-up phase of the engine by providing a lean fuel-air mixture during stationary operation of the engine and a temporarily enriched mixture when the throttle valve is suddenly opened.

OBJECTS AND SUMMARY OF THE INVENTION

It is, therefore, a principal object of the present invention to provide an improved fuel injection system of the known type which enables the fuel-air mixture to be enriched for a specific period of time when a sudden acceleration occurs during the warm-up phase of the engine.

This object and others are accomplished according to the present invention by the provision of a relief valve and a damping throttle, wherein the relief valve is controllable as a function of the pressure drops at the damping throttle. The damping throttle is disposed between a pressure chamber and a control pressure conduit.

According to an advantageous feature of the present invention the control pressure in the pressure chamber can only be reduced for a short period of time by the relief valve via a relief conduit when there is a sudden acceleration during the warm-up phase of the engine and the control pressure in the control pressure conduit is reduced by the pressure control valve.

Another advantageous feature of the present invention consists in that the movable valve part of the relief valve is controllable by a flexible membrane (diaphragm) which is exposed on the one side to the control pressure in the control pressure conduit and on the other to atmospheric pressure and by means of which pressure may be exerted on a valve part having a smaller diameter than the diaphragm by the control pressure in the pressure chamber.

Another advantageous feature of the present invention consists in that the movable valve part is in the form of a sleeve valve rigidly connected at its one end to the diaphragm. The sleeve valve comprises an axial bore containing the damping throttle and connecting the control pressure conduit and the pressure chamber. The sleeve valve is provided at its end remote from the diaphragm with a flexible packing ring.

BRIEF DESCRIPTION OF THE DRAWING

The sole FIGURE illustrates a fuel injection system according to a preferred embodiment of the present invention including the structure for varying the fuel-air mixture delivered to the engine during warm-up operation.

DESCRIPTION OF THE PREFERRED EMBODIMENT

In the embodiment of the fuel injection system illustrated, the combustion air flows in the direction of the arrow through a suction tube portion 1 past an air sensing element or air sensor 2, which is disposed in a conical portion 3. From the conical portion 3 the air flows through a suction tube portion 4 and thereafter through a coupling hose 5 into a suction tube portion 6 in which there is disposed an arbitrarily operable throttle valve (butterfly valve) 7. From the latter the combustion air flows to one or more cylinders (not shown) of an internal combustion engine. The air sensor 2 consists of a plate disposed at right angles to the direction of air flow and is displaced in the conical suction tube portion 3 as an approximately linear function of the air flowing through the suction tube. Given a constant restoring force exerted on the air sensor 2 as well as a constant pressure prevailing upstream of the air sensor 2, the pressure prevailing between the air sensor 2 and the throttle valve 7 also remains constant.

The air sensor 2 directly controls a metering and distributing valve 10. For the transmission of the motion of the air sensor 2 there is provided a lever 11 which is connected to the air sensor at one end and pivotably mounted by a pivot point 12 at the other end. The lever 11 is provided with a nose 13 and during the pivoting movement of the lever the nose 13 actuates a movable slide member 14 which forms part of the metering and distributing valve 10. The slide member 14 serves as a control plunger including a front face 15 which is remote from the nose 13. The front face 15 is exposed to the force of pressurized liquid. The pressure of this liquid acting on the fact 15 produces the restoring force which is exerted on the air sensor 2.

Fuel is supplied by means of a fuel pump 19 which is driven by an electric motor 18 and which draws fuel from a fuel tank 20 and delivers it through a conduit 21 to the fuel metering and distributing valve 10. From the conduit 21 there extends a conduit 22 in which is disposed a pressure limiting valve 23. When there is excessive pressure in the system the pressure limiting valve allows fuel to flow back into the fuel tank 20.

From the fuel supply conduit 21 the fuel is admitted into a channel 26 provided in the housing of the fuel metering and distributing valve 10. The channel 26 leads to an annular groove 27 of the control plunger 14 and further leads through several branch conduits to the chambers 28 of one side of a diaphragm 29 so that this side is exposed to fuel pressure. Depending on the axial position of the control plunger 14 the annular groove 27 opens to a greater or lesser extent control slots 30 which lead through channels 31 to respective chambers 32. Each of the latter is separated from a chamber 28 by means of a diaphragm 29. From the chambers 32 the fuel is admitted through injection channels 33 to the individual fuel injection valves (not shown) which are positioned in the suction tube in the vicinity of their associated engine cylinder. The diaphragm 29 serves as the movable member of a flat seat valve which, when the fuel injection system is inoperative, is kept open by means of a spring 34. The diaphragm boxes each formed of a chamber 28 and 32 ensure that, independently of the overlap occurring between the annular groove 27 and the control slots 30, that is, independently of the quantity of fuel flowing to the fuel injection valves, the pressure drop at the fuel metering valves 27, 30 remains substantially constant. In this way, it is ensured that the extent of displacement of the control plunger 14 and the metered fuel quantity are proportional to one another.

During a pivotal movement of the lever 11, the air sensor 2 is moved in the conical portion 3 of the suction tube and, as a result, the annular flow passage section between the air sensor and the cone changes in proportion to the extent of displacement of the air sensor.

The liquid producing the constant restoring force on the control plunger 14 is fuel. To provide for this, there extends from the conduit 21 a conduit 36 which is separated from a control pressure conduit 38 by means of an uncoupling throttle 37. The conduit 38 discharges into a pressure chamber 39 into which the front face 15 of the control plunger 14 projects. The pressures exerted in pressure chamber 39 is influenced by a camping throttle 40.

Connected to the control pressure conduit 38 there is provided a pressure control valve 42, by means of which the pressure fluid can return without pressure into the fuel tank 20 through a return line 43. The pressure of the pressure fluid producing the restoring force may be controlled as a function of temperature by means of the pressure control valve 42. The pressure control valve 42 is embodied as a flat seat valve having a stationary valve seat 44 and a diaphragm 45 which is biased in the closing direction of the pressure control valve by a spring 46. The closing force exerted by the spring 46 is transmitted by a pin 47 held by a support 48 and a spring washer 49 between the diaphragm 45 and the spring 46. At temperatures below the engine operating temperature the spring 46 acts against one end of a bimetallic spring 50 via the spring washer 49. At its other end, the bimetallic spring 50 is bolted by means of a bolt 51 pressed into the housing of the pressure control valve 42. The bimetallic spring 50 is largely protected from heat loss by the conduction of heat to the housing of the pressure control valve by an insulating member 52 disposed between the bolt 51 and the bimetallic spring 50. An electric heating element 53 is mounted on the bimetallic spring 50.

According to the present invention, the damping throttle 40 is defined by a sleeve valve 56 which comprises the movable part of a relief valve 57 and which is guided by a flexible diaphragm 58 at its one end. The sleeve valve 56 includes an axial bore 59, to which the damping throttle 40 is adjacent. Thus the pressure chamber 39 and the control pressure conduit 38 are in constant communication via the damping throttle 40 and the axial bore 59. The end of the sleeve valve 56 which is remote from the membrane 58 is provided with a packing ring 60. The packing ring 60 is made of a flexible material, for example, rubber or plastic material, thereby avoiding any damage to the valve seat and valve member during operation and for ensuring a good sealing action. The sleeve valve 56 cooperates with a relief bore 61 and a conduit 65 via which the pressure fluid can flow back into the fuel tank 20 when the relief valve 57 is in the open state. The diaphragm 58 separates a chamber 62, in which the control pressure of the control pressure conduit 38 is effective, from a chamber 63 which communicates with the relief bore 61 by way of a compensating bore 64.

The fuel injection system described operates in the following manner:

When the internal combustion engine is running, fuel is drawn from the tank 20 by the pump 19 which is driven by the electric motor 18. The fuel is delivered through the conduit 21 to the fuel metering and distributing valve 10. At the same time, the internal combustion engine draws air through the suction tube 1 and, as a result, the air sensor 2 undergoes a certain excursion from its rest position. In response to the deflection of the air sensor 2, the control plunger 14 is displaced via the lever 11 and thus the flow passage section at the control slots 30 is increased. The direct connection between the air sensor 2 and the control plunger 14 ensures a constant ratio between the quantity of air and the metered quantity of fuel provided the characteristics of these two components are sufficiently linear (which is desideratum in itself). The fuel-air ratio would then be constant for the entire operational range of the engine. However, it is necessary for the fuel-air mixture to be richer or leaner depending on the operating conditions of the internal combustion engine and this is achieved by varying the restoring force acting on the air sensor 2. To this end, there is connected to the control pressure conduit 38 the pressure control valve 42 which, by reducing the pressure of the pressure fluid during the warm-up phase of the internal combustion engine, influences the mixture enrichment as a function of temperature until the operating temperature of the engine is attained. The control pressure is determined by the closing force of the spring 46 transmitted by the pin 47 against the diaphragm 45. When the temperatures are below the operating temperature of the engine, however, the bimetallic spring 50 exerts force on the spring washer 49 in opposition to the force of the spring 46, with the effect that the closing force exerted on the diaphragm 45 is reduced. However, immediately after the engine is started, the bimetallic spring 50 is heated by means of the electric heating element 53 which results in a reduction in the force transmitted by the bimetallic spring 50 against the spring washer 49. The requisite initial biasing of the bimetallic spring 50 can be achieved simply by pressing the bolt 51 into the housing of the pressure control valve 42 to variable depths.

In addition to the quantity of fuel metered by the metering and distributing valve 10 in proportion to the quantity of air, it is desirable to obtain a quantity of fuel (acceleration fuel) in order to provide a richer fuel-air mixture when a sudden acceleration occurs, for example, during the warm-up phase of the engine. During such a phase the pressure in the pressure chamber 39 is reduced for a short time via the relief valve 57. A reduction of the pressure of the pressure fluid in the pressure chamber 39 causes a reduction in the restoring force exerted on the air sensor 2. Thus, while the throughgoing quantity of air at the air sensor 2 remains constant, the deflection of the air sensor and thus of the control plunger 14 is greater and accordingly, a larger quantity of fuel is metered at the metering valve 27, 30. The relief valve 57 opens when a sudden acceleration occurs as a result of the sudden increase in pressure in the pressure chamber 39 which is due to the increased displacement force on the air sensor 2 when the throttle valve 7 is suddenly opened and which cannot be discharged sufficiently rapidly via the damping throttle 40 to the control pressure circuit 38. In the course thereof, the control pressure in the control pressure circuit 38 acts on the diaphragm 58 controlling the sleeve valve 56 in the closing direction of the valve and, in the opening direction, the atmospheric pressure in the chamber 63 and the pressure in the pressure chamber 39 by means of the sleeve valve 56 which has a smaller diameter than the diaphragm. According to the present invention the relief valve 57 is designed in such a way that it only opens when the control pressure in the control pressure circuit 38 is lowered by the pressure control valve 42 during the warm-up state of the engine. When the control pressure in the control pressure circuit 38 is again raised by the pressure control valve 42 upon termination of the warm-up state, the pressure drop which is produced when a sudden acceleration occurs at the damping throttle 40 is not sufficient to open the relief valve 57 and to release pressure from the pressure chamber 39 via the relief bore 61. Thus, the fuel injection system according to the present invention provides automatic enrichment of the fuel-air mixture in the event of acceleration during the running-up stage of the engine.

What is claimed is:

1. In a fuel injection system for externally ignited internal combustion engines including:

a. a suction tube for air intake to the engine;

b. an air sensor disposed in said suction tube;

c. an arbitrarily operable throttle valve disposed in said suction tube in series with said air sensor;

d. a fuel supply conduit;

e. a control pressure conduit;

f. a fuel metering valve connected to said fuel supply conduit and said control pressure conduit for continuously injecting fuel into said suction tube, said fuel metering valve having a pressure chamber defined therein;

g. a control plunger, serving as the movable member of said fuel metering valve, said control plunger being acted upon on one end by said air sensor, and on an opposite end, which extends into said pressure chamber, by a return force provided by liquid under constant but arbitrarily variable pressure delivered by said control pressure conduit, for metering a fuel quantity that is proportionate to the quantity of air flowing through the suction tube and measured by said air sensor; and h. a pressure control valve connected to the control pressure conduit for varying the pressure in said control pressure conduit in dependence on at least one operating parameter of the engine, said pressure control valve having a temperature-dependent control element disposed therein, the improvement comprising:

i. a relief valve connected to the control pressure conduit and the pressure chamber, said relief valve having a housing connected to the fuel metering valve, in the wall of which there is defined a relief conduit between the control pressure conduit and the pressure chamber, which is effective when a sudden acceleration occurs during the warm-up phase of the engine operation to reduce the pressure in the pressure chamber for a short period of time, and wherein in the course of the above pressure reduction the pressure control valve causes the pressure in the control pressure conduit to be reduced; and ii. means forming part of said relief valve and defining a damping throttle mounted in said housing, said damping throttle being disposed between the control pressure conduit and the pressure chamber so that said relief valve is controllable in dependence on the pressure drop at said damping throttle.

2. In a fuel injection system for externally ignited internal combustion engines including:

a. a suction tube for air intake to the engine;

b. an air sensor disposed in said suction tube;

c. an arbitrarily operable throttle valve disposed in said suction tube in series with said air sensor;

d. a fuel supply conduit;

e. a control pressure conduit;

f. a fuel metering valve connected to said fuel supply conduit and said control pressure conduit for continuously injecting fuel into said suction tube, said fuel metering valve having a pressure chamber defined therein;

g. a control plunger, serving as the movable member of said fuel metering valve, said control plunger being acted upon on one end by said air sensor, and on an opposite end, which extends into said pressure chamber, by a return force provided by liquid under constant but arbitrarily variable pressure delivered by said control pressure conduit, for metering a fuel quantity that is proportionate to the quantity of air flowing through the suction tube and measured by said air sensor; and h. a pressure control valve connected to the control pressure conduit for varying the pressure in said control pressure conduit in dependence on at least one operating parameter of the engine, said pressure control valve having a temperature-dependent control element disposed therein, the improvement comprising:

i. a relief valve connected to the control pressure conduit and the pressure chamber, said relief valve having a relief conduit, which is effective when a sudden acceleration occurs during the warm-up phase of the engine operation to reduce the pressure in the pressure chamber for a short period of time, wherein in the course of the above pressure reduction the pressure control valve causes the pressure in the control pressure conduit to be reduced;

ii. means forming part of said relief valve and defining a damping throttle, said damping throttle being disposed between the control pressure conduit and the pressure chamber so that said relief valve is controllable in dependence on the pressure drop at said damping throttle; and iii. a diaphragm forming part of said relief valve, said diaphragm being exposed on one side to the pressure in the control pressure conduit and on the other side to atmospheric pressure, wherein the means defining the damping throttle comprises a movable valve part of the relief valve which has a smaller diameter than the diaphragm, and wherein the movable valve part is controlled in its movement by the diaphragm so that the pressure in the pressure chamber may be exerted on the movable valve part.

3. The fuel injection system as defined in claim 2, wherein the movable valve part is formed as a sleeve valve which is rigidly connected at one end to the diaphragm.

4. The fuel injection system as defined in claim 3, wherein the sleeve valve has an axial bore formed therein, said axial bore serving to define the damping throttle and connect the pressure chamber and the control pressure conduit.

5. The fuel injection system as defined in claim 3, wherein the relief valve further includes a flexible packing ring disposed at the end of the sleeve valve which is remote from the diaphragm.

* * * * *